US007414539B2

(12) United States Patent
Sakai

(10) Patent No.: US 7,414,539 B2
(45) Date of Patent: Aug. 19, 2008

(54) SIMPLE ALARM DEVICE

(76) Inventor: Nobuyo Sakai, 6-27-3, Komagome, Toshima-ku, Tokyo (JP)

( * ) Notice: Subject to any disclaimer, the term of this patent is extended or adjusted under 35 U.S.C. 154(b) by 221 days.

(21) Appl. No.: 11/503,797

(22) Filed: Aug. 14, 2006

(65) Prior Publication Data

US 2007/0052538 A1 Mar. 8, 2007

(30) Foreign Application Priority Data

Aug. 19, 2005 (JP) ..... 2005-238902
Oct. 19, 2005 (JP) ..... 2005-303928

(51) Int. Cl.
*G08B 21/00* (2006.01)

(52) U.S. Cl. ..... 340/686.3; 340/545.1; 49/13; 49/72; 116/67; 116/85; 232/34

(58) Field of Classification Search ..... 340/545.1, 340/545.2, 686.3; 49/13, 72; 116/67, 75, 116/85; 232/34, 35, 37
See application file for complete search history.

(56) References Cited

U.S. PATENT DOCUMENTS

| | | | | |
|---|---|---|---|---|
| 4,271,405 | A * | 6/1981 | Kitterman | 340/512 |
| 4,604,609 | A * | 8/1986 | Wakefield, Jr. | 340/548 |
| 4,742,336 | A * | 5/1988 | Hall et al. | 340/539.11 |
| 5,317,303 | A * | 5/1994 | Ross et al. | 340/539.26 |
| 5,489,890 | A * | 2/1996 | Moser | 340/546 |
| 6,786,005 | B1 * | 9/2004 | Williams | 49/141 |
| 6,940,405 | B2 * | 9/2005 | Script et al. | 340/545.1 |

FOREIGN PATENT DOCUMENTS

| | | |
|---|---|---|
| JP | 1-297792 | 11/1989 |
| JP | 7-114675 | 5/1995 |
| JP | 10-309250 | 11/1998 |
| JP | 11-53989 | 2/1999 |
| JP | 2003-281636 | 10/2003 |
| JP | 3101410 | 2/2004 |

* cited by examiner

*Primary Examiner*—Jeff Hofsass
*Assistant Examiner*—Edny Labbees
(74) *Attorney, Agent, or Firm*—Day Pitney LLP

(57) ABSTRACT

A simple crime prevention alarm device for the windows of dwelling houses or the like. The alarm device can be simply and easily attached to and placed on various kinds of objects, such as windows or the like, to prevent crime. The manufacturing cost and the attachment cost are reduced, and further provide a simple alarm device which can be used as an urgent call means. A simple crime prevention alarm device for windows according to this invention comprises a casing, and the casing houses therein a reel for taking up a string, a coil spring for giving a force of taking up the string around the reel, a switching-on projection means operation switch when the reel is rotated by the pulling-out of the string or the pulling-in of the string due to the coil spring, an alarm operation switch adapted to be turned on when the switching-on projection means has kicked the switch by the pulling-out of the string or the pulling-in of the string due to the coil spring, an alarm sound generating device which is operated by the alarm operation switch, and a battery which serves to give power to the alarm sound generating device. The string is provided at a free end thereof with a fixing means which can be secured to a window frame, while the casing comprises an attachment means for attaching the casing itself.

7 Claims, 6 Drawing Sheets

(a)

(b)

(a)

(b)

SIMPLE ALARM DEVICE

This application claims priority to Japanese Applications JP2005-303928 with a filing date of Aug. 19, 2005 and JP2005-238902 with a filing date of Oct. 19, 2005.

This invention relates to a simple alarm device which can be simply placed on an object to be prevented from crime (Hereinafter referred to as a crime prevention object), an opening and closing means such as the windows of a house, or the like, and particularly relates to a simple crime prevention alarm device, which detects the movement of crime prevention objects, and the intrusion from the windows of a dwelling house or the like, and a method of using the simple alarm device.

BACKGROUND OF THE INVENTION

Today, crime prevention systems for dwelling houses have spread, and as crime prevention systems for dwelling houses crime prevention sensors for windows are used, which detect a person who intrudes from a window into a room. As a conventional crime prevention sensor for windows, there is an opening and closing detection type sensor comprising in combination a magnet, and a reed switch, which operates due to the access and alienation of the magnet. This sensor operates in such a manner that, when an intruder opens a window, the reed switch operates to generate a signal of detection (See for e.g. JP2003-281636A). Furthermore, there is an arm-end disengagement detection type in which an arm is rotatably held at one end thereof on one of the window frames or the like and is provided at the other end thereof with a reed switch, which is made to detachably engage a holder secured to the other of the window frames. This sensor operates in such a manner that when a part of an intruder's body comes into contact with the arm, the other end of the arm is disengaged from the holder, and a state of operation of the reed switch varies to thereby generate a signal of detection (See for e.g. JP07-114675A).

Since the sensor systems of these conventional techniques involved large-scale equipment, complicated in the operations of attaching to the windows, and required a lot of time and expense in the attaching and placing operations, a device has been desired which can be simply and easily placed by an armature, besides which, is inexpensive.

At present, a number of simple alarm devices, which are generally on the market, are ones which are directly attached to doors or windows, and which operate to detect sound or vibration to thereby generate a signal. However, in such devices, catching information of sound by noise and of vibration by wind, and issuing a false signal come into question. Moreover, since, in horizontally sliding doors, the gap between the doors is narrow, a thin device is required, and devising with respect to the above-mentioned question is necessary.

Furthermore, a device issuing an alarm sound has recently been used as an urgent call means by elderly men or women in elder care or by a sick person in a hospital.

An object of this invention is to provide a simple crime prevention alarm device for dwelling houses or the like, which can be simply and easily attached to and placed on the required area of a crime prevention object, a window or the like, and which allows the manufacturing cost and the attachment cost to be reduced. A further object is to provide a simple alarm device which can be used as an urgent call means.

SUMMARY OF THE INVENTION

The problem of this invention is solved by a crime prevention alarm device, characterized by a casing, said casing housing therein a reel for taking up a string, a coil spring providing power for taking up around the reel, a switching-on projection means which is arranged in the circumference of the reel and which is adapted to kick a switch when the reel is rotated by the pulling-out of the string or the pulling-in of the string due to the coil spring, said switch comprising an alarm operation switch adapted to be turned on when the switching-on projection means has kicked the switch by the pulling-out of the string or the pulling-in of the string due to the coil spring, an alarm sound generating device which sounds an alarm due to the operation of the alarm operation switch, and a battery which serves to give power to the alarm sound generating device, said string being provided at a free end thereof with a fixing means which can be secured to a predetermined spot, while the casing comprises an attachment means for attaching the casing itself.

The crime prevention alarm device for windows according to this invention has a feature in that said alarm device is attached to and placed on a crime prevention object and the point of placement, and the pulling-out of the string followed by the movement of the crime prevention object or the pulling-in of the string due to the coil spring causes the switching-on projection means to kick the switch to thereby bring about the switching-on operation thereof, so that an alarm sound is generated.

The alarm device according to this invention has a feature in that the casing is provided in the center of the rear surface thereof with an engaging slot, and the casing of the device is placed on an attachment plate in such a manner that said engaging slot is made to engage a split pin provided in the center of the attachment plate, so that the casing can be freely rotated about the split pin. Furthermore, this construction allows the pull string for operation of the reel to be always pulled out in the perpendicular direction from the casing of the alarm device regardless of the position where the string is pulled, and the alarm device proper is detachably attached to the attachment plate.

A method of using the alarm device according to this invention has a feature in that the device is used as an emergent alarm means for a sick person, an elderly person, or the like in such a manner that the alarm device proper and the fixing means attached to the free end of the string are secured to the interior of the room, such as a sickroom, and a further pull string body connected to the first-described string by way of a ring or the like is suspended to a position where said further pull string body can be operated by a sick or elderly person.

BRIEF DESCRIPTION OF THE DRAWINGS

FIG. 5 shows a method of using the alarm device according to this invention as an urgent alarm means for a sick person or an elderly person, or the like.

EXPLANATION OF REFERENCE NUMERALS

Figure 1:
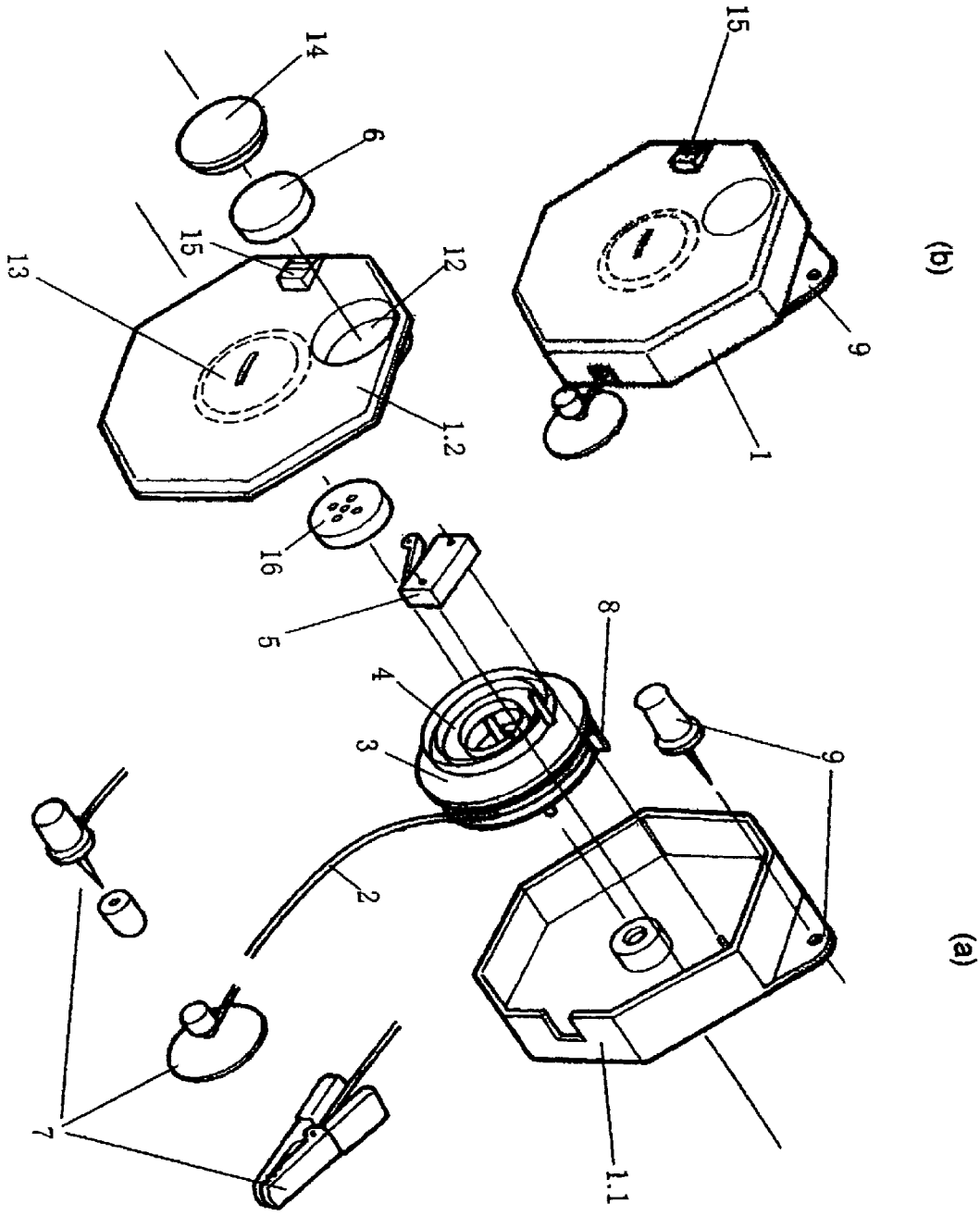
FIG. 1*a* is an exploded perspective view of a crime prevention alarm device according to this invention.
FIG. 1*b* is a perspective view of a crime prevention alarm device according to this invention.

1. Casing
1.1. Casing housing part
1.2. Casing lid part
2. String
3. Take-up reel
4. Coil spring
5. Alarm operation switch
6. Battery
7. Fixing means
8. Switching-on projection means
9. Attachment means of a crime prevention alarm device
10. Window frame
11. Window frame
12. Battery housing window
13. Buzzer placing aperture
14. Lid for a battery housing part
15. Setting switch
16. Alarm buzzer
17. Attachment and securing means such as a pin
18. Attachment plate
19. Split pin
20. Double-sided adhesive tape
21. Slot
22. Ring
23. String body
30. Sick or elderly person

DETAILED DESCRIPTION OF THE INVENTION

In the case where the crime prevention alarm device according to this invention is used for windows, it can be placed by attaching the casing of this alarm device to one of the window frames and attaching the fixing means at the free end of the string of this alarm device to the other of the window frames. In this way, anyone can place it simply and easily, in a short time. This enables an intruder from the window or the like of a dwelling house to be detected to thereby issue an alarm, so that a crime prevention system for dwelling houses can be simply formed.

The alarm device according to this invention is a crime prevention alarm device, which is extremely simple in construction and moderate in price, and which can be widely used on crime prevention objects, for example, pictures, bags, washing, bicycles or the like, and which makes it possible to carry out the attaching operation to the crime prevention objects in an extremely easy manner, thereby enabling a crime prevention system which is inexpensive in all respects, to be provided.

Since the alarm device according to this invention is constituted so that, when the setting switch and the alarm operation switch are switched on in series, an alarm is issued, it has an advantage of not causing the consumption of the battery at the time of warning. Since the pull string for operating the reel is colored to the degree of half the length by which the string can be pulled out, the degree (limit) to which the string can be pulled out can be learned.

Since, in the alarm device according to this invention, the casing of the device is placed on the attachment plate, the casing of the device can be freely rotated by 360 degrees, thereby enabling the device to be operated even when the fixing means is attached to the alarm device in any direction thereof. Since this freely rotatable construction allows the pull string to be pulled from all directions, the fixing means can be placed in all directions from the spot where the alarm device is placed.

Since, in this invention, the alarm device proper is detachably attached to the attachment plate, it is possible to remove the alarm device proper from the attachment spot with the attachment plate being left placed on the attachment spot, and to place it on another object such as a bicycle or the like, or otherwise to carry it with one.

Furthermore, the alarm device according to this invention can be used as a device, which sounds an alarm, such as an urgent call means or the like by an elderly person receiving assisted care, or by a sick person in a hospital.

Now, this invention will be explained in detail by way of the best embodiment with reference to the accompanying drawings. FIG. 1 shows a crime prevention alarm device according to this invention, FIG. 1*a* is an exploded perspective view of the crime prevention alarm device according to this invention, and FIG. 1*b* is a perspective view before attachment of the crime prevention alarm device according to this invention.

A crime prevention alarm device according to this invention comprises a casing 1, which houses therein a reel 3 for taking up a string 2, a coil spring 4 for providing power for taking up the string 2 around the reel 3, a switching-on projection means 8 which is arranged in the circumference of the reel 3 and which is adapted to kick a switch 5 when the reel 3 is rotated by the pulling-out of the string 2 or the pulling-in of the string 2 due to the coil spring 4, an alarm operation switch 5 adapted to be turned on when the switching-on projection means 8 has kicked the switch 5 by the pulling-out of the string 2 or the pulling-in of the string 2 due to the coil spring 4, an alarm sound generating device 16 which is operated by the switch 5, and a battery 6 which serves to give power to the alarm sound generating device, such as an alarm buzzer 16 or the like, said string 2 being provided at a free end thereof with a fixing means 7 by which said device can be secured to a window frame.

Since this string 2 is colored with a gay color such as red, yellow, or the like to the degree of half the amount of length by which the string can be pulled out, the degree (limit) to which the string can be pulled out can be learned. Moreover, this switching-on projection means 8 is a mechanical means; however, instead of this, an electric/magnetic means or an optical means may be used in such a manner as to operate the alarm switch 5 when the reel 3 is rotated by a certain angle. A plurality of projection means 8 may also be arranged in the circumference of the reel 3. This projection means 8 is operated even when the reel 3 is rotated in any of the left and right directions of rotation.

The casing 1 consists of a casing housing part 1.1 and a casing lid part 1 .2. In this casing housing part 1.1, an alarm sound generating device 16, which is operated by the switching-on of the switch 5, is provided. This casing lidpart 1.2 is provided with an insertion window 12 through which the battery 6 can be inserted, and a buzzer fitting aperture 13. A lid 14 for a battery housing part is fitted in the insertion window 12, and an alarm buzzer 16 is fitted in the buzzer fitting aperture 13. For the fixing means 7, various kinds of suitable fixing means can be used, including an absorption disc, or an absorption disc to which a double-sided adhesive tape is affixed, a clothespin, a pin and a pin receiver, or the like.

Furthermore, in this crime prevention device, the casing 1 is provided with an attachment means 9, by which the casing itself can be attached to the appropriate spot. Although, as the attachment means 9, FIG. 1 shows a projection with an aperture therein and a pin, it is sufficient to be an inexpensive suitable means. There is provided a setting switch 15, which is used to switch on and off the circuit of an alarm operation switch 5 provided on the upper wall of the casing housing part 1.1. The crime prevention alarm device is placed with the setting switch 15 being turned to the OFF position, and after the placement, the setting switch 15 is set to the ON position. Since, in this state, i.e., during a warning, the alarm operation switch 5 inside the alarm device is in the OFF position, there is no consumption of the battery. In other words, when the setting switch 15 and the alarm operation switch 5 have come into the ON position in series, an alarm is issued, and therefore, at the time of warning, the battery is not consumed. In general, the switch 15 is left to be set so as to operate after the alarm device has been placed on an area of a crime prevention object; however, if a timer (a delay circuit) is provided, the switch 15 can also be set to operate after a certain time.

Figure 2:
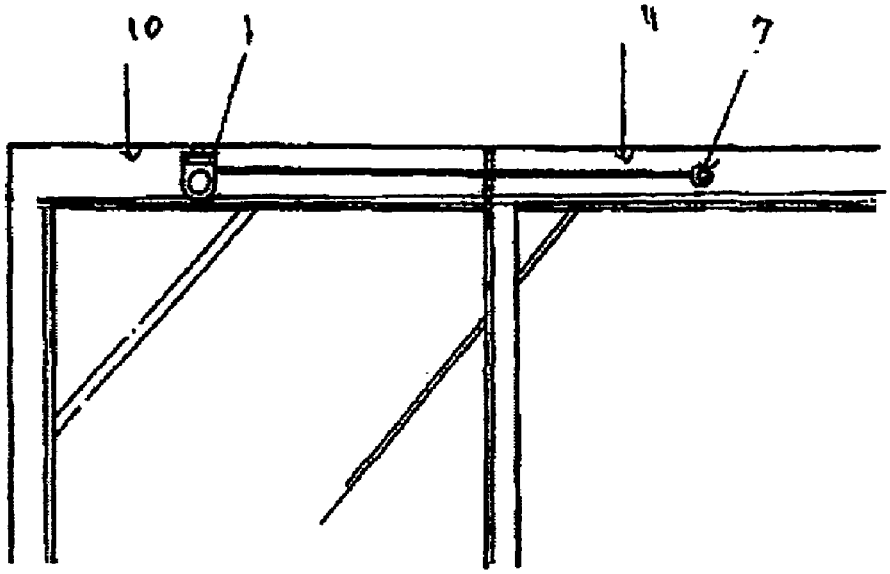
FIG. 2*a* is a front view showing the crime prevention alarm device for windows according to this invention attached to window frames.
FIG. 2*b* is a side view showing the crime prevention alarm device for windows attached to the window frames.
Figure 2:
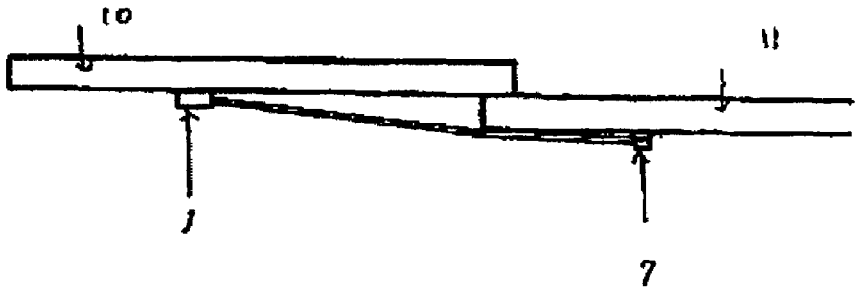

FIG. 2 shows a mode in which the crime prevention alarm device according to this invention is attached to the window frames of a dwelling house as a crime prevention alarm for windows, FIG. 2*a* shows a front view showing the crime prevention alarm device for windows attached to the window frames, and FIG. 2*b* shows a side view showing the crime prevention alarm device attached to the window frames. The crime prevention alarm device for windows according to this invention is placed in such a manner that the casing 1 is attached to one of the window frames 10 and the fixing means secured to the free end of the string 2 is attached to the other of the window frames 11.

Accordingly, if an intruder attempts to open the window to intrude into a dwelling house, since the crime prevention alarm device is secured to the window frames 11 and 10 by means of the fixing means 7 such as an adhesion tape or the like, and the casing attaching means 9, opening the window causes the string 2, which does not disengage from the window frame 11, to loosen, and the reel 3 takes up the loosened string 2. In this way, when the reel 3 is rotated due to the movement of the string 2, the projection means 8 kicks the switch 5 to thereby turn on the switch 5, and the alarm sound generation device is operated by an electric current from the battery 6, so that an alarm is issued. In this alarm sound generating device, when the reel 3 is rotated by the pulling-out of the string or the pulling-in of the string due to the coil spring, the projection means 8 kicks the switch 5 to thereby turn on it, so that the alarm buzzer 16 or the like generates an alarm sound. This device sounds an alarm even when either window of the window frame 10 or 11 is moved. In short, this device has an advantage that two windows can be monitored by one alarm device.

Figure 3:
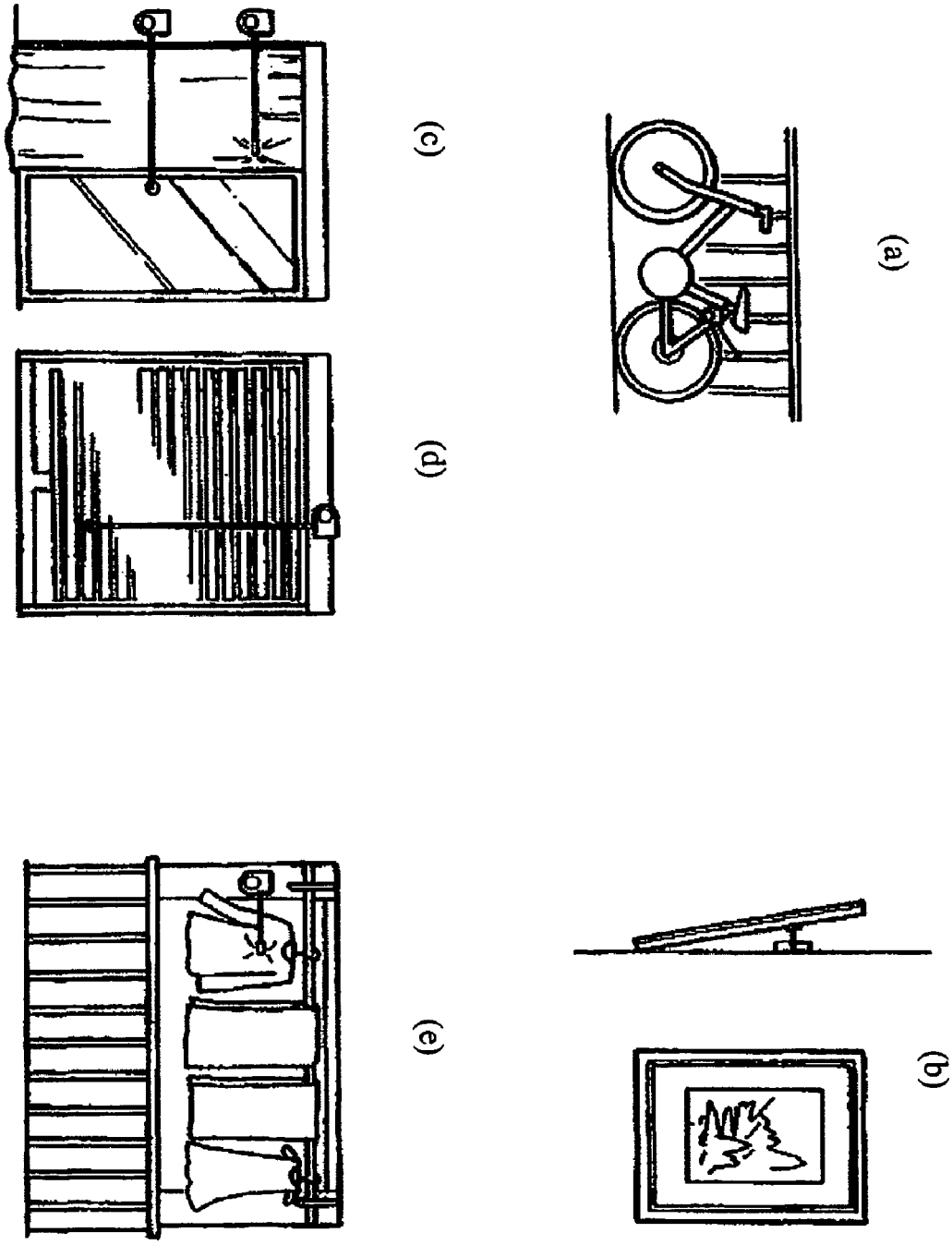
FIG. 3 shows examples in which the crime prevention device according to this invention is placed on various kinds of crime prevention objects.

FIG. 3 shows examples in which the crime prevention alarm devices according to this invention are placed on various kinds of crime prevention objects. FIG. 3(*a*) shows the crime prevention alarm device placed between a bicycle and a building such as a wall or the like, FIG. 3(*b*) shows the crime prevention alarm device placed between a picture and a wall, FIG. 3(*c*) shows the crime prevention alarm device placed between a curtain or a door and a wall, FIG. 3(*d*) shows the crime prevention alarm device placed between a blind and a window frame, and FIG. 3(*e*) shows the crime prevention alarm device placed between washing and a column. The crime prevention alarm device according to this invention is a device having an extremely simple construction, which is moderate in price, which makes it possible to be widely used for crime prevention objects, for example, pictures, bags, washing, bicycles or the like, and which also makes it possible to carry out the work of attaching said device to the crime prevention objects in an extremely easy manner.

Figure 4:
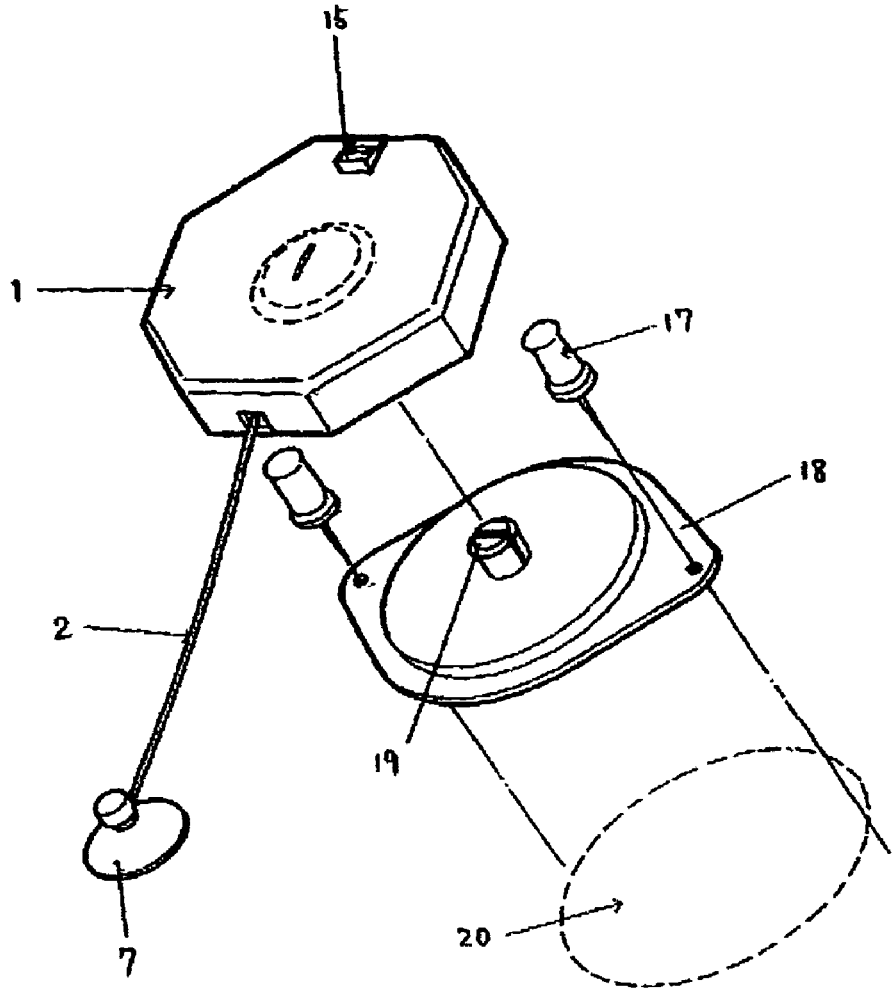
FIG. 4 shows a mode of attaching the casing of the alarm device to an attachment plate.
Figure 4:
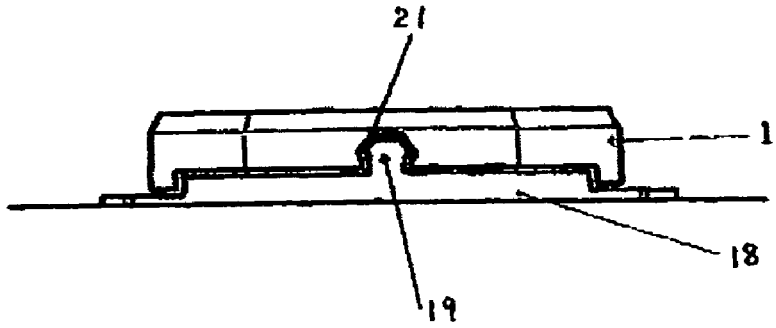

FIG. 4 shows a mode in which a casing 1 of an alarm device according to this invention is attached to an attachment plate 18. In the alarm device according to this invention, the casing 1 is provided with an engaging slot 21 in the center of the rear surface thereof, and the casing 1 of the device is placed on the attachment plate 18 in such a manner that the engaging slot 21 is made to engage a split pin 19 provided in the center of the attachment plate 18, so that the casing 1 of the device can be freely rotated with the split pin 19 in the center. In this way, since the casing 1 of the device can be freely rotated with the split pin 19 in the center, the pull string 2 for operation of the reel is rotated according to the position where a person pulls the string, so that it can be always pulled out in the perpendicular direction from the casing 1 of the alarm device. If a double-sided adhesive tape 20 is affixed on the bottom surface of the attachment plate 18, the alarm device can be attached to the spot where placement of said device is desired. The casing 1 of the alarm device, which can be freely rotated as shown in FIG. 4, has preferably point symmetry in shape, unlike the casing 1 which is not provided with the rotating construction shown in FIG. 1.

Moreover, since the split pin 19 of the attachment plate 18 has a slit, which causes an elastic action, thereby enabling the casing 1 to be detachably attached to the attachment plate 18 by means of the engaging means consisting of the engaging slot 21 and the split pin 19. Accordingly, it is possible to remove the alarm device from the placement spot, with the attachment plate 18 being left placed on the attachment spot, and to place it on another place such as on a bicycle or the like, or to carry it with one.

Figure 5:
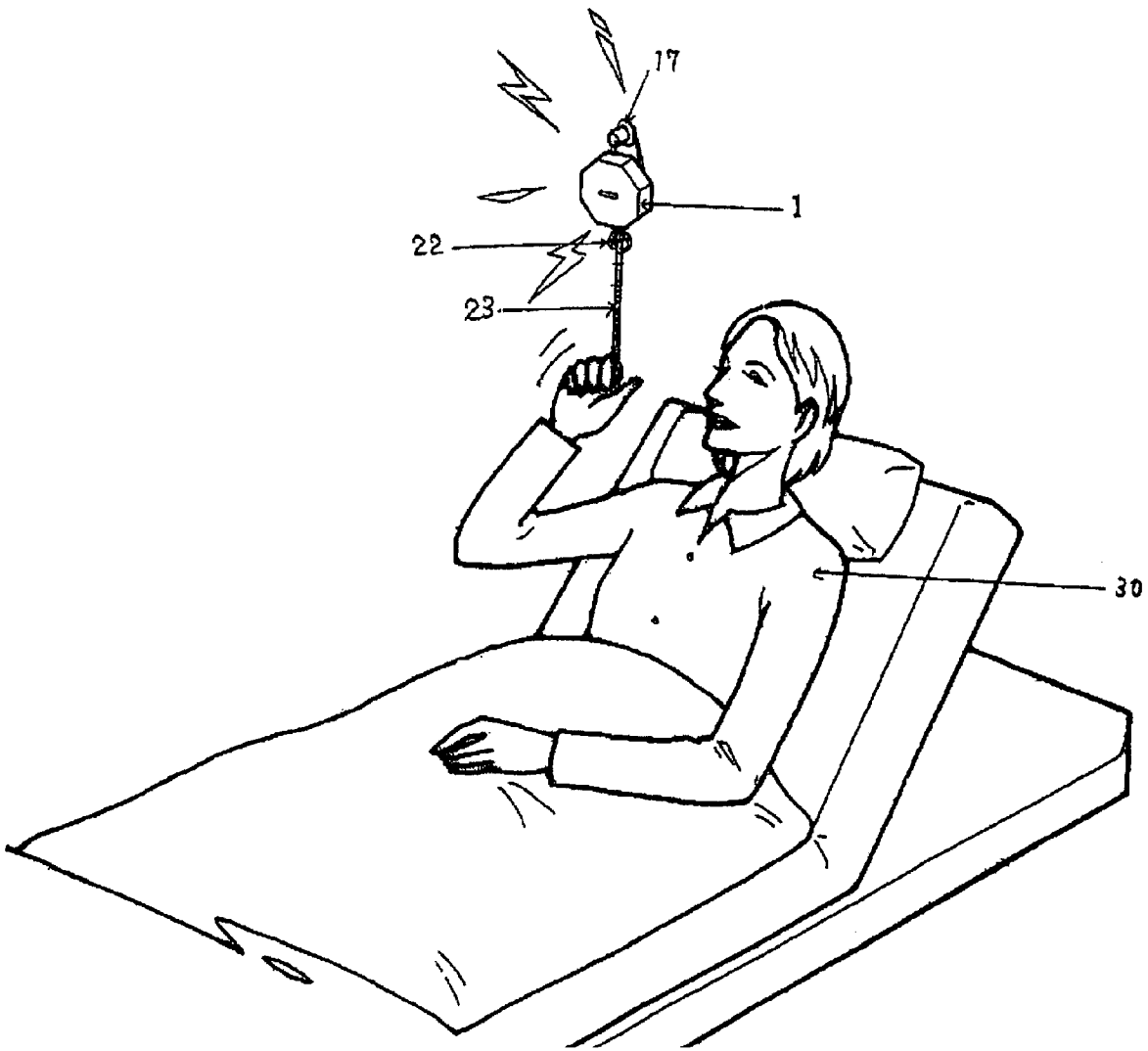

FIG. 5 shows a method of using the alarm device according to this invention as an urgent alarm means for a sick person, an elderly person, or the like. The alarm device proper 1 is fixed to the wall within a room by means of an attachment means 17 such as a pin or the like, and at the time of an urgent call, a sick person or an elderly person pulls the string 2 so that an alarm is sounded to indicate the need for an urgent response. Alternatively, as shown in FIG. 6, it is possible to attach and secure the alarm device proper 1 by means of the attachment means 17 such as a pin or the like, and further attach and secure the fixing means 7 connected to the free end of the string 2, to the interior of a room such as a sickroom or the like, and then suspend a further pull string 23 connected to the alarm operation string 2 by way of a ring 22 or the like, to a position where a sick person 30 or an elderly person can operate the further pull string 23, thereby enabling the alarm device to be used as an urgent alarm means for the sick or elderly person.

Figure 6:
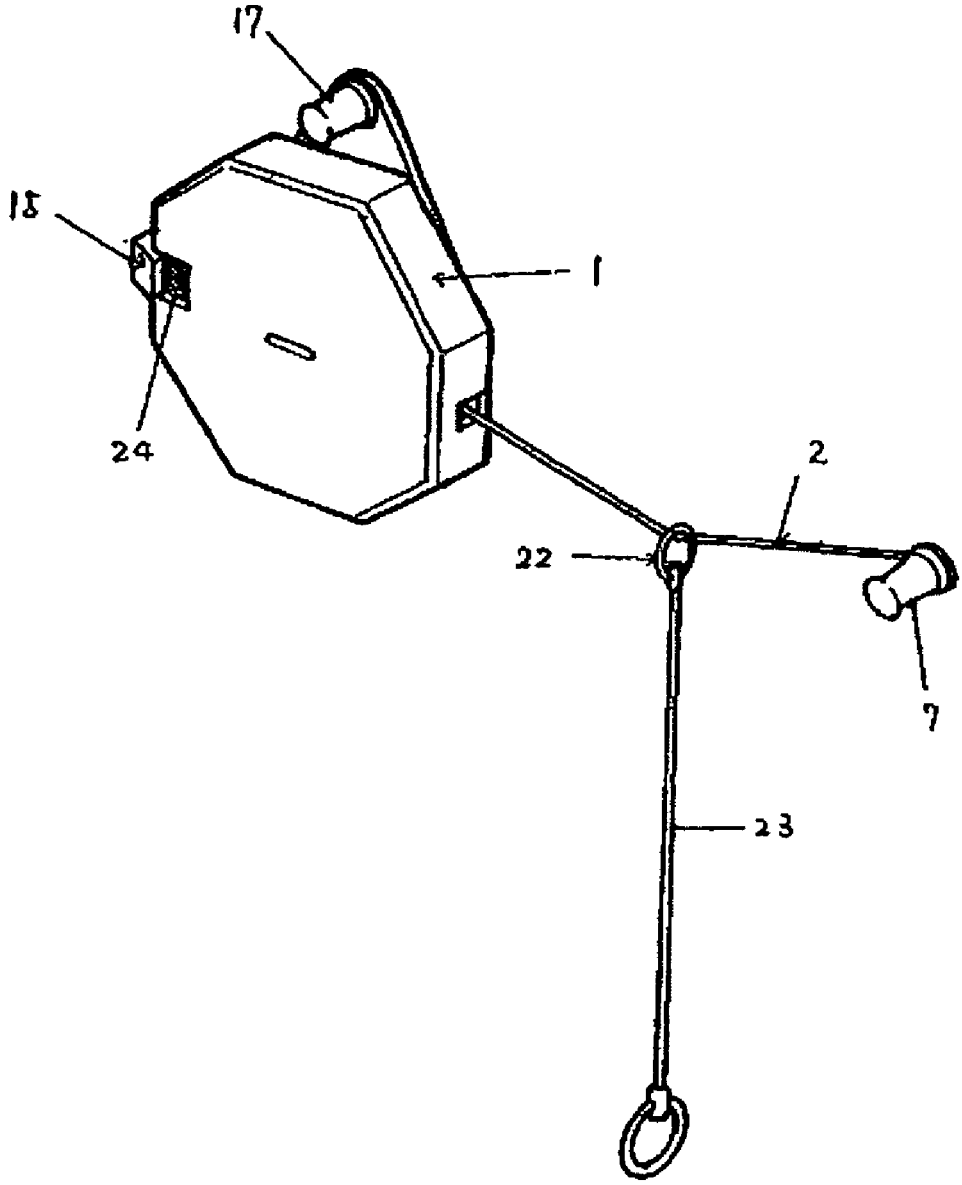
FIG. 6 is a perspective view of the alarm device according to this invention which is attached and secured to a suitable spot for use, and which is set to operate.

FIG. 6 is a perspective view of an alarm device 1 according to this invention, which is attached and secured to an appropriate spot for use and is set to operate. The alarm device proper 1 is secured to a suitable spot for use by an attachment means 17 such as a pin or the like, and further, the fixing means 7 attached to the free end of the string 2 is also secured, a further pull string body 23 being attached to the string 2 by way of a ring 22 or the like. In this drawing, the setting switch 15 for switching on and off the circuit of the alarm operation switch 5 is set to operate, and fluorescent paint 24 is applied thereto.

This switching-on state can be confirmed due to two states, one where the setting switch 15 projects out of the alarm device proper 1, and the other where said fluorescent paint 24 appears.

What is claimed is:

1. An alarm device, comprising a casing, said casing housing therein a reel for taking up a string, a coil spring for providing power for taking up the string around the reel, a switching-on projection means which is arranged in the circumference of the reel and which is adapted to kick a switch when the reel is rotated by the pulling-out of the string or the pulling-in of the string due to the coil spring, said switch comprising an alarm operation switch adapted to be turned on when the switching-on projection means has kicked the switch by the pulling-out of the string or the pulling-in of the string due to the coil spring, an alarm sound generating device which sounds an alarm due to the operation of the alarm operation switch, and a battery which serves to give power to the alarm sound generating device, said string being provided at a free end thereof with a fixing means which can be secured to a predetermined spot, while the casing comprises an attachment means for attaching the casing itself, that the casing is provided in the center of the rear surface thereof with an engaging slot, and the casing of the device is placed on an attachment plate in such a manner that said engaging slot is made to engage a split pin provided in the center of the attachment plate, so that the casing can be freely rotated about the split pin, and that the alarm device proper is detachably attached to the attachment plate.

2. An alarm device as claimed in claim 1, wherein said alarm device is attached and placed on a crime prevention object and the point of placement, and the pulling-out of the string followed by the movement of the crime prevention object or the pulling-in of the string due to the coil spring causes the switching-on projection means to kick the alarm operation switch, to thereby bring about the switching-on operation thereof so that an alarm sound is generated.

3. An alarm device as claimed in claim 1 or 2, wherein a setting switch is provided for switching on and off the circuit of the alarm operation switch.

4. An alarm device as claimed in claim 1, wherein said fixing means comprises a simple fixing means such as an absorption board, a clothespin, a pin and a pin receiver, or the like.

5. An alarm device as claimed in claim 1, wherein the pull string which operates the reel is colored to the degree of half the length, by which the string can be pulled out.

6. An alarm device as claimed in claim 1, wherein the pull string for operation of the reel is always pulled out in the perpendicular direction from the casing of the alarm device, regardless of the position where the string is pulled.

7. A method of using an alarm device claimed in claim 1 as an emergent alarm means for a sick person, an elderly person, or the like which comprises fixing the alarm device and the fixing means to the interior of a room, and connecting a further pull string body to the pull string by way of a ring or the like and suspending it to a position where said further pull string body is pulled by the sick or elderly person, or the like for soliciting help or attention when the sick, and elderly person or the like is under distress or in need of help or attention.

* * * * *